US008025368B2

(12) United States Patent
Watanabe

(10) Patent No.: US 8,025,368 B2
(45) Date of Patent: Sep. 27, 2011

(54) INJECTION HEAD MANUFACTURING METHOD AND INJECTION HEAD

(75) Inventor: Hideo Watanabe, Tokyo (JP)

(73) Assignee: Konica Minolta IJ Technologies, Inc. (JP)

( * ) Notice: Subject to any disclaimer, the term of this patent is extended or adjusted under 35 U.S.C. 154(b) by 968 days.

(21) Appl. No.: 11/869,147

(22) Filed: Oct. 9, 2007

(65) Prior Publication Data

US 2008/0088678 A1 Apr. 17, 2008

(30) Foreign Application Priority Data

Oct. 13, 2006 (JP) ..... 2006-280645

(51) Int. Cl.
*B41J 2/045* (2006.01)

(52) U.S. Cl. ..... 347/68; 347/20; 347/50; 347/54; 347/69; 347/71; 438/21; 29/890.1

(58) Field of Classification Search ..... 347/68, 347/69, 71; 438/21; 29/890.1
See application file for complete search history.

(56) References Cited

U.S. PATENT DOCUMENTS 5,736,278 A * 4/1998 Nakazawa et al. ..... 430/7
7,004,561 B2 * 2/2006 Murakami et al. ..... 347/40
2002/0073544 A1 6/2002 Yamada
2003/0011660 A1 1/2003 Nishi et al.
2004/0130602 A1 * 7/2004 Watanabe ..... 347/68
2006/0017778 A1 * 1/2006 Okuno ..... 347/50
2006/0055741 A1 * 3/2006 Watanabe et al. ..... 347/68
2007/0030316 A1 * 2/2007 Watanabe ..... 347/68
2007/0070125 A1 * 3/2007 Watanabe ..... 347/58

FOREIGN PATENT DOCUMENTS

EP 0505188 A2 9/1992
JP 2004-90374 3/2004
JP 2006-35454 2/2006

OTHER PUBLICATIONS

European Search Report for European Application No. EP07-254006 mailed Feb. 14, 2008.

* cited by examiner

*Primary Examiner* — Ryan Lepisto
(74) *Attorney, Agent, or Firm* — Cantor Colburn LLP

(57) ABSTRACT

A flow path regulating member for regulating an ink flow path leading into the channels is formed on the rear side of the head chip by exposure and development through lamination of the photo masks having an opening of a predetermined pattern, after a photosensitive resin film has been bonded on the rear side of the head chip by heat and pressure without using an adhesive; this head chip being characterized in that the channels, and drive walls made up of piezoelectric elements are arranged alternately, the apertures of the channels are arranged on the front side and rear side, respectively, and drive electrodes are formed in channels.

1 Claim, 10 Drawing Sheets

INJECTION HEAD MANUFACTURING METHOD AND INJECTION HEAD

This application is based on Japanese Patent Application No. 2006-280645 filed on Oct. 13, 2006, in Japanese Patent Office, the entire content of which is hereby incorporated by reference.

FIELD OF THE INVENTION

The present invention relates to an injection head manufacturing method and an injection head, particularly to a method of manufacturing an injection head wherein a flow path regulating member for regulating the flow path of ink into the channel is arranged on the rear side of the head chip, and the injection head manufactured thereby.

BACKGROUND OF THE INVENTION

The conventional art has provided a share mode type injection head wherein voltage is applied to the electrode formed on a drive wall which is separating the channel so that shear deformation, is caused at the drive wall and the ink inside the channel is emitted from the nozzle using the pressure generated inside the channel at this time. As this share mode type injection head, an injection head provided with the so-called harmonica type head chip is known, wherein the drive walls made up of piezoelectric elements and the channels are arranged alternately, and a channel aperture is arranged on each of the front side and rear side (Patent Document 1, 2).

In the case of an injection head having such a harmonica type head chip, ink is supplied into each channel from the rear side of the head chip. Accordingly, an ink manifold is connected to the rear side of the head chip, and the ink stored in this ink manifold is supplied to each channel.

Incidentally, as disclosed in the Patent Documents 1 and 2, the rear side of such a head chip is provided with a flow path regulating member for regulating the flow of ink into the channel by reducing the area of the aperture on the channel inlet side.

FIG. 15 is a rear side view of the head chip 600 connected with a flow path regulating member 500. This drawing illustrates a harmonica type head chip 600 wherein the air channels 601 that do not emit ink and the ink channels 602 that emit ink are arranged alternately.

The flow path regulating member 500 utilizes a plastic film such as a sheet of polyimide having the size capable of covering almost all the surfaces on the rear side of the head chip 600. This film is bonded using an adhesive as an epoxy adhesive. Here the rear side of each air channel 601 provided on the head chip 600 is completely blocked and an ink inlet 501 is formed so as to conform to each ink channel 602, thereby reducing the area of the aperture on the rear side (on the side supplied with ink) of each ink channel 602. The ink inlet 501 is provided, for example, by laser processing in such a way as to have a diameter smaller than that of the aperture on the rear side of the ink channel 602.

As described above, the area of the aperture on the rear side of the ink channel is reduced by the flow path regulating member 500, whereby easy control of the ink meniscus in the nozzle is ensured and high-speed drive is enabled. Thus, this arrangement provides the advantage of enhancing the drive characteristics.

When all the channels arranged on the head chip are ink channels, the ink inlets of the flow path regulating member are arranged so as to correspond to all the channels.

[Patent Document 1] Unexamined Japanese Patent Application Publication No. 2004-90374

[Patent Document 2] Unexamined Japanese Patent Application Publication No. 2006-35454

When the aforementioned flow path regulating member is connected to the rear side of the head chip, the coated adhesive may ooze from the ink inlet. This requires a large quantity of adhesive to be coated. This involves such problems as the excess adhesive flowing into the channel to block the channel and to cause emission failure, or ink flowing into the air channel due to insufficient coating of the adhesive. Further, it becomes difficult to provide contact pressure from the flow path regulating member side due to the adhesive oozing out of the ink inlet when the flow path regulating member is connected. This requires a great care to be taken at the time of coating the adhesive and during the connection work, and has caused manufacturing difficulties in the conventional art.

To ensure that the adhesive from the ink inlet does not ooze out, it may be possible to make such arrangements that the ink inlet is formed by laser processing after the flow path regulating member has been connected to the rear side of the head chip. However, this requires complication positioning work, for example, by use of a microscope, for the purpose of ensuring that each ink inlet will conform to the position of each ink channel, with the result that workability is deteriorated. Moreover, there is no solution to the problem of the channel being clogged by the excess adhesive.

Further, when the area of the aperture on the rear side of the channel is to be reduced by the flow path regulating member, the ink inlet having a smaller area than that of the aperture on the rear side of the channel is formed approximately at the center of the aperture in the conventional flow path regulating member. Thus, the bubble having occurred inside the channel at the time of driving cannot easily get out of the ink inlet, and remains inside the channel. The bubble remaining inside the channel prevents a sufficient amount of the emission pressure from being applied to the ink, with the result that emission failure occurs.

SUMMARY OF THE INVENTION

Thus, the object of the present invention is to provide an injection head manufacturing method capable of ensuring that a flow path regulating member is formed on the rear side of the harmonica type head chip without using an adhesive, wherein there is no concern for possible channel clogging.

Another object of the present invention is to provide an injection head containing a flow path regulating member on the rear side of the harmonica type head chip wherein there is no concern for possible channel being clogged by adhesive.

A further object of the present invention is to provide an injection head manufacturing method capable of ensuring that a flow path regulating member is formed on the rear side of the harmonica type head chip without having to use adhesive, wherein this injection head is characterized by freedom from a concern for possible channel clogging, and efficient removal of the bubble remaining in the channel, without bubbles being formed easily.

A still further object of the present invention is to provide an injection head characterized by a flow path regulating member being formed on the rear side of the harmonica type head chip, freedom from a concern for possible channel being clogged by adhesive, and efficient removal of the bubble remaining in the channel, without bubbles being formed easily.

Other objects of the present invention will become apparent from the following description:

The aforementioned objects can be achieved by the following:

1. A manufacturing method of an inkjet head having a head chip wherein channels and drive walls configured with piezoelectric elements are arranged alternately, apertures of the channels are arranged respectively at a front surface and a rear surface of the head chip, a drive electrode is formed in each channel, and a flow path regulating member arranged at the rear surface of the head chip to regulate ink flow into the channel, wherein shear deformation is caused at the drive wall by applying a voltage so that ink in the channel is emitted, the manufacturing method including steps of: adhering a photosensitive resin film by heat and pressure onto the rear surface of the head chip without using adhesives; covering the photosensitive resin film by a photo mask having openings in shape of a predetermined pattern; and exposing and developing the photosensitive resin film covered by the photo mask so as to form the flow path regulation member.

2. An inkjet head, including: a head chip wherein channels and drive walls configured with piezoelectric elements are arranged alternatively, aperture of each channel are arranged respectively at a front surface and a rear surface of the head chip, and a drive electrode formed in each channel; and a flow path regulating member arranged at the rear surface of the head chip to regulate ink flow into the channel, wherein shear deformation is caused at the drive wall by applying a voltage so that ink in the channel is emitted; wherein the flow path regulation member is formed by a photosensitive film which is adhered by heat and pressure onto the rear surface of the head chip without using adhesives.

DETAILED DESCRIPTION OF THE PREFERRED EMBODIMENT

Figure 1:
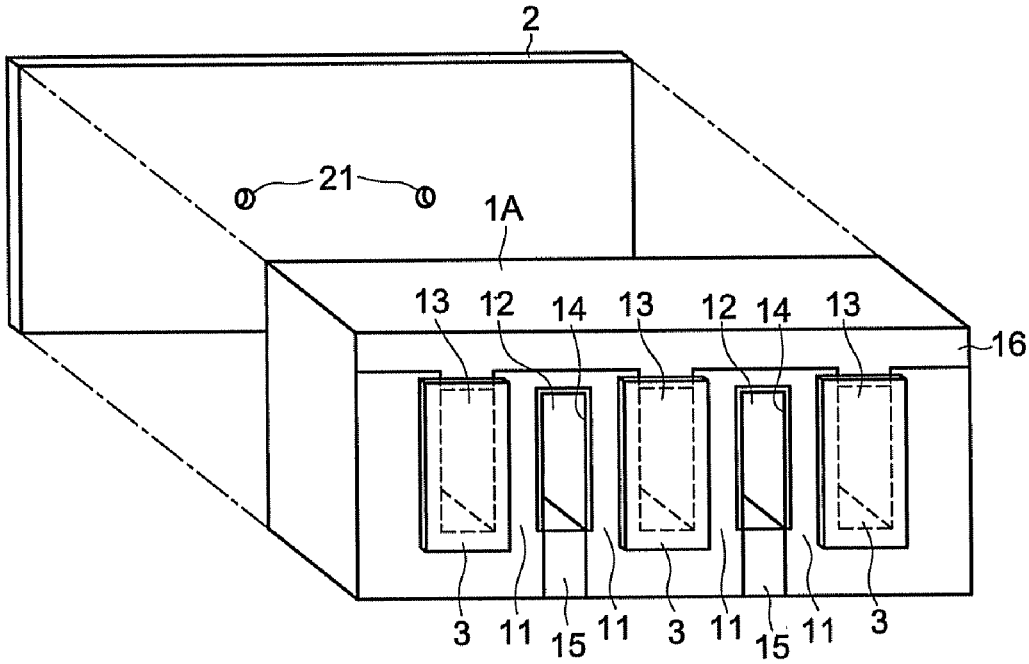
FIG. 1 is a perspective view showing the head chip portion of the injection head as a first embodiment as viewed from the rear side.

The following describes the embodiments of the present invention with reference to drawings:

FIG. 1 is a perspective view showing the head chip portion of the injection head as a first embodiment as viewed from the rear side;

In the drawing, the reference numeral 1A denotes a head chip and 2 indicates a nozzle plate connected with the front side of the head chip 1A.

In this Specification, the surface on the side wherein ink is emitted from the head chip is referred to as the "front side" and the surface opposite thereto is called the "rear side". The outer surfaces on the upper and lower portions in the drawing, sandwiching the channel juxtaposed in the head chip, are called the "upper side" and "lower side", respectively.

The drive walls 11 made up of piezoelectric elements, and channels 12 and 13 are arranged alternately on the head chip 1A. In this drawing, five channels 12 and 13 are illustrated by way of an example, without the number of the channels 12 and 13 being restricted thereto.

The head chip 1A is an independent channel type head chip wherein channels that emit ink (referred to as "ink channels" in some cases) 12 and the channels that do not emit ink (referred to as "air channels" in some cases) 13 are arranged alternately. Each of the channels 12 and 13 is configured in such a way that the walls on both sides rise almost vertical with respect to the upper side and lower side of the head chip 1A are parallel to each other.

Figure 2:
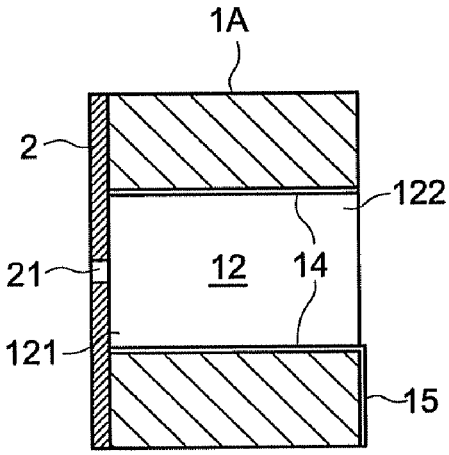
FIG. 2(*a*) is a cross sectional view of the injection head of FIG. 1, with FIG. 2(*b*) being a cross sectional view of an air channel.
Figure 2:
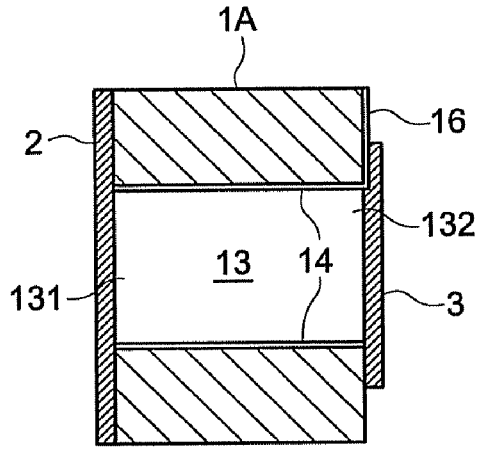

FIG. 2(*a*) is a cross sectional view of the injection head 12 of FIG. 1, and FIG. 2(*b*) is a cross sectional view of an air channel 13.

The apertures 121 and 131 on the front side of each of the channels 12 and 13, and the apertures 122 and 132 on the rear side are arranged face to face with each other on the front side and rear side of the head chip 1A. Each of the channels 12 and 13 is designed in a straight form with a very small change in size and shape along the length from the apertures 122 and 132 on the rear side to the apertures 121 and 131 on the front side.

A drive electrode 14 made up of Ni, Co, Cu, Al and others is formed in a closely linked configuration on the inner surface of each of the channels 12 and 13.

On the rear side of the head chip 1A, the connection electrodes 15 electrically connected with the drive electrode 14 in each of the ink channels 12 are formed by being separately pulled out downward in the drawing. One common electrode 16 electrically connected with all of the drive electrodes 14 inside each of the air channels 13 is formed by being pulled out upward in the drawing, in the direction opposite to the connection electrode 15.

Figure 3:
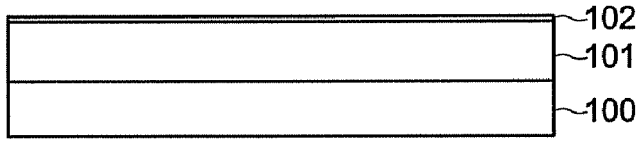
FIGS. 3(*a*) through (*e*) are explanatory diagrams representing the head chip manufacturing process.
Figure 3:
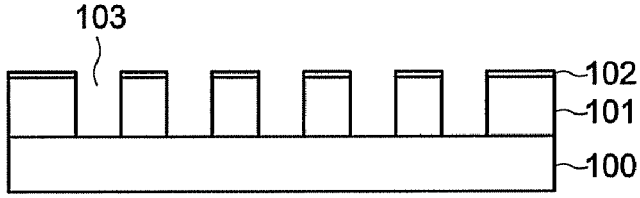
Figure 3:
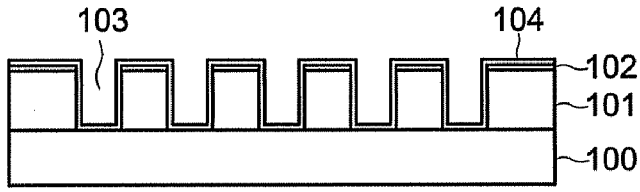
Figure 3:
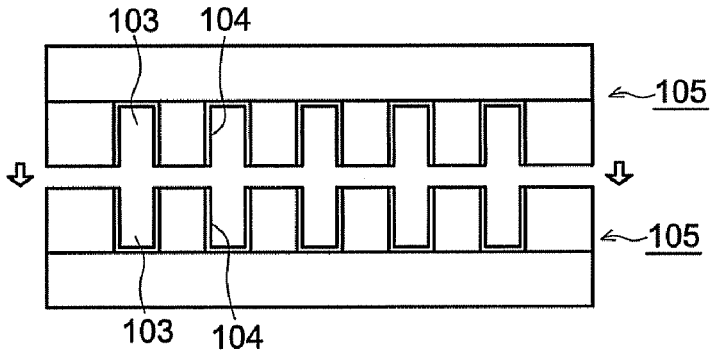
Figure 3:
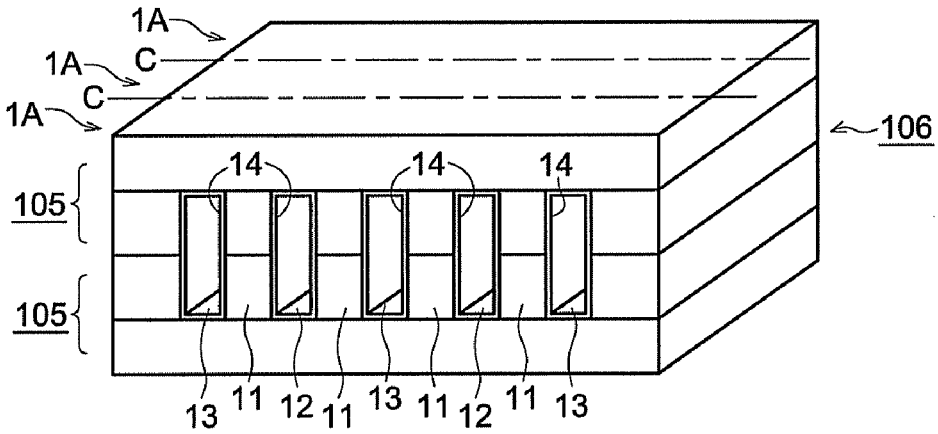
Figure 4:
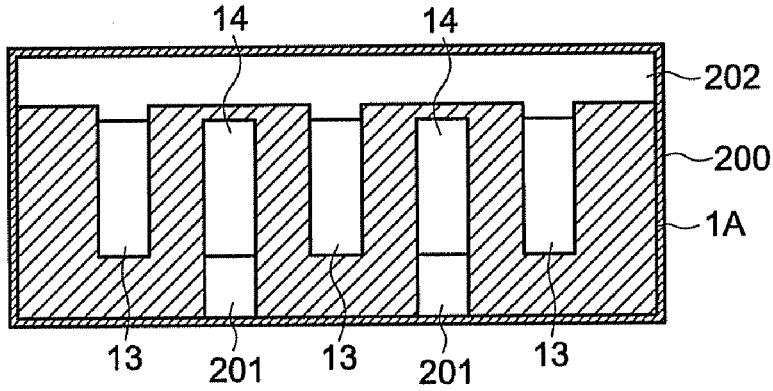
FIG. 4 is an explanatory diagram representing the head chip manufacturing process.

The following describes an example of manufacturing such as head chip 1A with reference to FIGS. 3 and 4 without the present invention being restricted thereto.

The piezoelectric element substrate 101 made up of polarized PZTs is connected to one substrate 100 using an epoxy based adhesive, and a photosensitive resin film 102 is bonded on the surface of the piezoelectric element substrate 101 (FIG. 3(*a*)).

Then from the side of the photosensitive resin film 102, a plurality of parallel grooves 103 are ground using a dicing blade and others. Each of the grooves 103 is ground from one end of the piezoelectric element substrate 101 to the other end at such a predetermined depth as to almost reach the substrate 100. This arrangement provides a straight form with a very small change in size and shape along the length (FIG. 3(*b*)).

After that, from the side wherein the grooves 103 have been ground, electrode forming metals such as Ni, Co, Cu, Al and others are applied by sputtering method, vapor deposition method or other means, so that a metallic membrane 104 is formed on the upper side of the resin film 102 having been left ungrounded, and on the inner surface of each groove 103 (FIG. 3(*c*)).

This is followed by the step of removing the photosensitive resin film 102, together with the metallic membrane 104 formed on the surface thereof. This will yield a substrate 105 wherein the metallic membrane 104 is formed only on the inner surface of each groove 103. Two substrates 105 having been formed in the similar manner are prepared, and a positioning step is taken to ensure that the grooves 103 of each substrate 105 will match each other. Then an epoxy based adhesive or the like is used to bond them together (FIG. 3(*d*)).

The head substrate 106 having been produced is cut in the direction perpendicular to the length of the groove 103, whereby a plurality of harmonica type head chips 1A are produced. The grooves 103 are formed into the channels 12 and 13, and the metallic membrane 104 in each groove 103 is formed into a drive electrode 14. The drive wall 11 is created between the adjacent grooves 103. The width between the cut lines C, C . . . determines the drive length (L) of the ink channel 12 of the head chips 1A, 1A . . . produced separately, and is determined adequately in response to this drive length (FIG. 3(*e*)).

The rear side of the head chip 1A having been obtained is provided with a photosensitive resin film 200 wherein an opening 201 for forming a connection electrode 15, and an opening 202 for forming a common electrode 16 are formed by exposure and development. From the side of the photosensitive resin film 200, such electrode metals as Ni, Co, Cu and Al are applied so that the connection electrode 15 and common electrode 16 are formed inside each of the openings 201 and 202 on a selective basis (FIG. 4).

The openings 201 and 202 are preferably provided over all the surfaces of the channels 12 and 13 when consideration is given to the working efficiency in the development and rinsing processes of the photosensitive resin film 200. This preferred arrangement ensures easy removal of the developing solution and rinsing water from the channels 12 and 13.

A nozzle plate 2 is connected to the front side of the head chip 1A in the aforementioned manner as shown in FIG. 1 and FIG. 2. The nozzle plate 2 is provided with a nozzle 21 only at the position conforming to the ink channel 12. Thus, the aperture 131 on the front side of the air channel 13 which does not emit ink is blocked by the nozzle plate 2.

Such a harmonica type head chip 1A is provided with the flow path regulating members 3 for regulating the flow path independently for each air channel 13 to ensure that ink is supplied from the rear side and that ink is not supplied to the aperture 132 on the rear side of each air channel 13. Thus, this aperture 132 is completely blocked.

Figure 5:
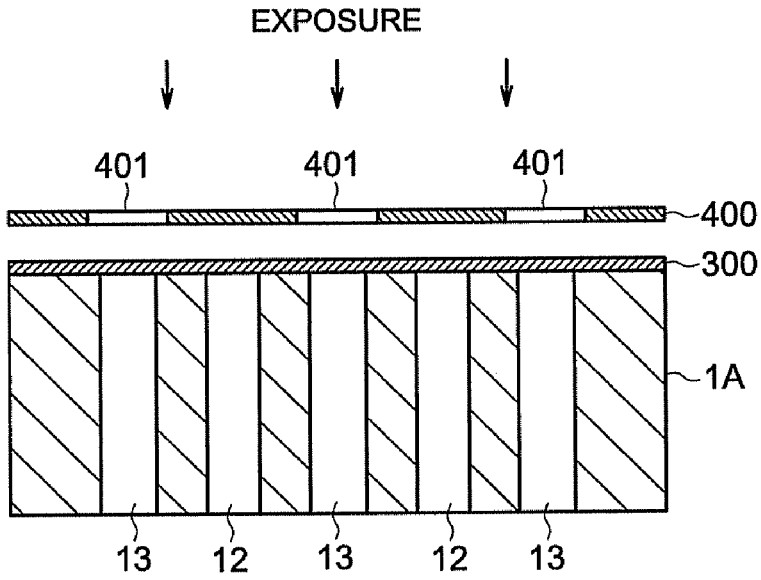
FIG. 5 is a diagram representing the flow path regulating member manufacturing process, wherein (a) is a cross sectional view of the head chip, and (b) is a rear side view of the head chip.
Figure 5:
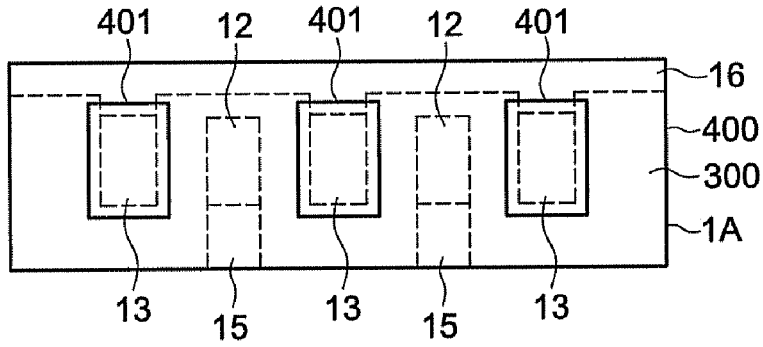
Figure 6:
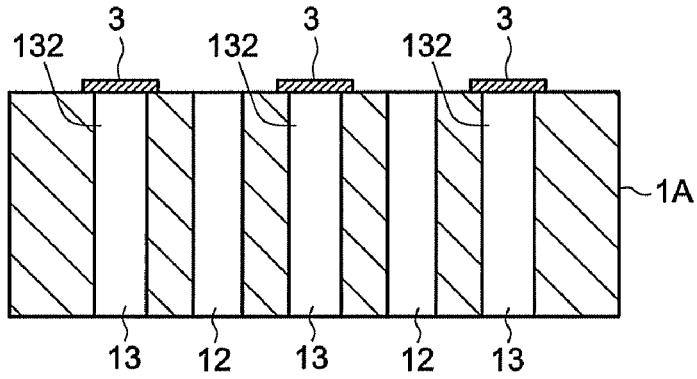
FIG. 6 is a diagram representing the flow path regulating member manufacturing process, wherein (a) is a cross sectional view of the head chip, and (b) is a rear side view of the head chip.
Figure 6:
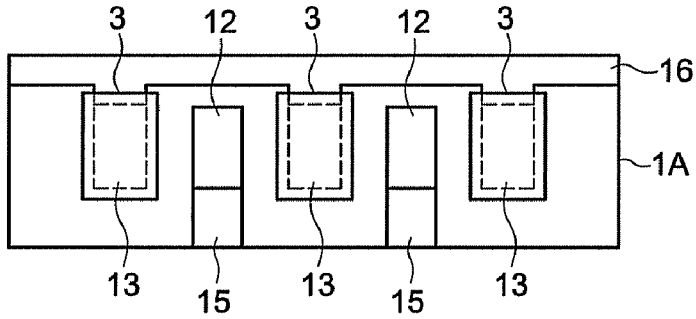

The following describes the way of forming this flow path regulating member 3 with reference to FIG. 5 and FIG. 6. Note that the drive electrode 14 is not illustrated in FIG. 5 and FIG. 6.

The flow path regulating member 3 is preferably formed on the rear side of the head chip 1A before the nozzle plate 2 is connected. Accordingly, as shown in FIGS. 5(*a*) and (*b*), a photosensitive resin film 300 is bonded by heat and pressure on the head chip 1A wherein the connection electrode 15 and common electrode 16 have been formed on the rear side, over the entire surface of the rear side using a laminator apparatus, without using an adhesive. In this case, both the apertures 122 and 132 on the rear side of each of the ink channel 12 and air channel 13 are completely blocked by the photosensitive resin film 300.

Various forms of commercially available photosensitive resin films (called the photosensitive dry film) can be used as the photosensitive resin film 300. The photosensitive cover ray film "Raytec" by Hitachi Chemical Co., Ltd. can be mentioned as an example.

In this Example, the FR-5425 having a thickness of 25 μm was used, and was bonded on the rear side of the head chip 1 by heat and pressure using a laminator apparatus. The thickness of the photosensitive resin film 300, namely, the film thickness of the flow path regulating member 3 is preferably in the range of 10 through 100 μm from the viewpoint of film strength and resolution in the exposure and development processes.

After that, the surface thereof is coated with a photo mask 400. The photo mask 400 is a rectangular opening 401 having an aperture area a slightly greater than that of the aperture 132 on the rear side of each air channel 13 of the head chip 1A, so that light can pass through only this opening 401. Thus, by exposure achieved by using this photo mask 400, only the photosensitive resin film 300 around each air channel 13 to which light is applied is exposed to light.

An exposure apparatus is used to position the photo mask 400 with respect to the rear side of the head chip 1A. This positioning can be achieved to an accuracy of several microns. This accuracy cannot possibly be achieved by the conventional way of bonding a plate having an open ink inlet as a flow path regulating member.

After the photo mask 400 had been coated, the ultraviolet ray was applied from the side of the photo mask 400. The amount of exposure was 100 mJ/cm$^2$. After that, the photo mask 400 was removed, and the material was developed, washed and dried by 1% $Na_2CO_3$ using a developer having a temperature of 30 degrees Celsius.

Thus, the flow path regulating members 3, 3 . . . made up of photosensitive resin films are independently formed on the rear side of the head chip 1A so that the aperture 132 on the rear side of each air channel 13 is blocked, as shown in FIGS. 6(*a*) and (*b*).

After the aforementioned drying process, the entire surface is preferably exposed to 1 J/cm$^2$ ultraviolet ray from the side of this flow path regulating member 3, and the flow path regulating member 3 is preferably baked at 160 degrees Celsius for one hour. Further, the reaction of the photosensitive resin film proceeds to produce a film characterized by excellent durability.

Various types of dry films such as dry film resists FRA 063 and FX900 by Du Pont Co., Ltd., and the photosensitive polyimide film by Mitsui Petrochemical Industries, Ltd. can be used as a photosensitive resin film. It is also possible to utilize a photosensitive cover ray film for printed wiring board. As will be described later, especially when parylene is used as a protective film, the photosensitive resin film is not required to have resistance to ink in particular. Accordingly, various forms of photosensitive resin films can be employed.

According to the present invention, the flow path regulating member 3 is bonded by heat and pressure using the photosensitive resin film 300, without using an adhesive. After that, the photo masks 400 with an opening 401 having a predetermined pattern are stacked one on top of the other, whereby the flow path regulating member 3 is formed by exposure and development. This arrangement completely eliminates the possibility of the problems that have occurred in the conventional method wherein the adhesive applied on the rear side of the head chip flows into the ink channel to cause the channel to be clogged, or the ink flows into the air channel due to insufficient amount of the coated adhesive.

Figure 7:
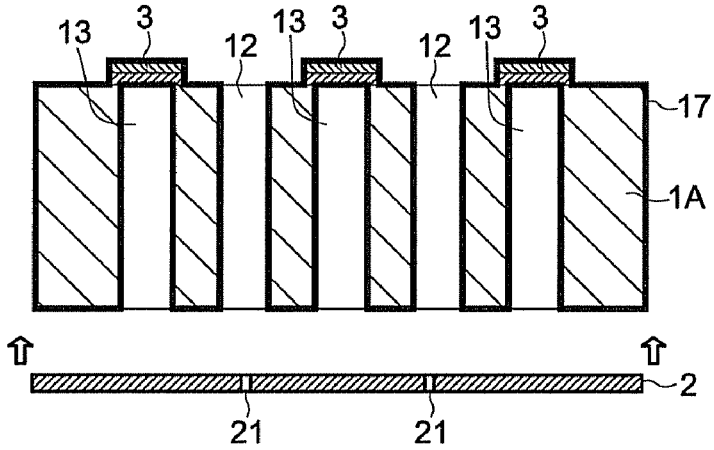
FIG. 7 is a diagram showing the head chip manufacturing process.

Incidentally, since the drive electrode 14 in the ink channel 12 is brought in direct contact with ink. When water based ink is used, a protect film must be coated on the surface of the drive electrode 14. Further, the flow path regulating member 3 is also brought in direct contact. When a solvent based ink is used, it is necessary to provide a protective film to protect the flow path regulating member 3 from the solvent. After the flow path regulating member 3 has been formed in the aforementioned manner, all the surfaces of the head chip 1A, namely, the surface of each drive electrode 14 and the surface of the flow path regulating member 3 are preferably coated with a protective film 17, as shown in FIG. 7. Here the drive electrode 14 is not illustrated.

A film made of paraxylylene and derivatives thereof (hereinafter referred to as "parylene film 17) is preferably used as a protective film 17 for coating. The parylene film 17 is a resin film made of a polyparaxylylene resin and/or its derivative resin. It is formed by the Chemical Vapor Deposition: CVD method) wherein the solid diparaxylylene dimer or its derivative is a source of vapor deposition. To be more specific, the paraxylylene radical produced by vaporization and thermal decomposition of the diparaxylylene dimer is adsorbed on the surfaced of the head chip 1A, and a film is formed by polymerization.

There are various types of parylene films 17. In response to required performances, various forms of parylene films, or a multi-layer parylene film made up of a plurality of these parylene films laminated one on top of the other can be used as a desired parylene film 17.

Such a parylene film 17 preferably has a thickness of 1 μm through 10 μm.

The parylene film 17 permeates fine areas to form a film. Thus, if the head chip 1A is coated before the nozzle plate 2 is connected, the drive electrode 14 as well as the flow path regulating member 3 are protected against ink since both the inner surface facing the interior of the air channel 13 and the outer surface exposed to the rear side of the head chip 1A are coated with the parylene film 17.

The flow path regulating member 3 is protected on both sides by the formation of this parylene film 17, with the result that the durability is greatly improved. Generally, due to insufficient adhesive strength, the surface of the photosensitive resin film must be roughened to enhance adhesive strength in some cases. Since the parylene film 17 sufficient adhesive strength when bonded with the substrate, the flow path regulating member 3 is pushed from both sides by the parylene film 17, and the flow path regulating member 3 having insufficient adhesive strength can also be used for a long time.

Should a pin-hole occur to the parylene film 17 for coating the flow path regulating member 3 so that the solvent based ink permeates, the parylene film 17 per se does not dissolve, and continues to be present on both surfaces of the flow path regulating member 3. Thus, it does not lose the function as the flow path regulating member, and its reliability is maintained for a long period of time.

Moreover, as in the present embodiment, the flow path regulating member 3 is formed independently for each air channel 13. Thus, the adverse effect of a pin-hole having occurred to the parylene film 17 is restricted to the flow path regulating member 3 alone, so that the flow path regulating member 3 of other air channels 13 is not affected. This arrangement provides an advantage that the damage is kept to a minimum.

Needless to say, regardless of the presence or absence of the parylene film 17, the flow path regulating member 3 is formed independently for each air channel 13. This arrangement ensures that other flow path regulating members 3 are not affected, even if separation or other defects have occurred to any of the flow path regulating members 3.

After the parylene film 17 has been formed in the aforementioned manner, the nozzle plate 2 is connected to the front side of the head chip 1A, as shown in FIG. 7.

Figure 8:
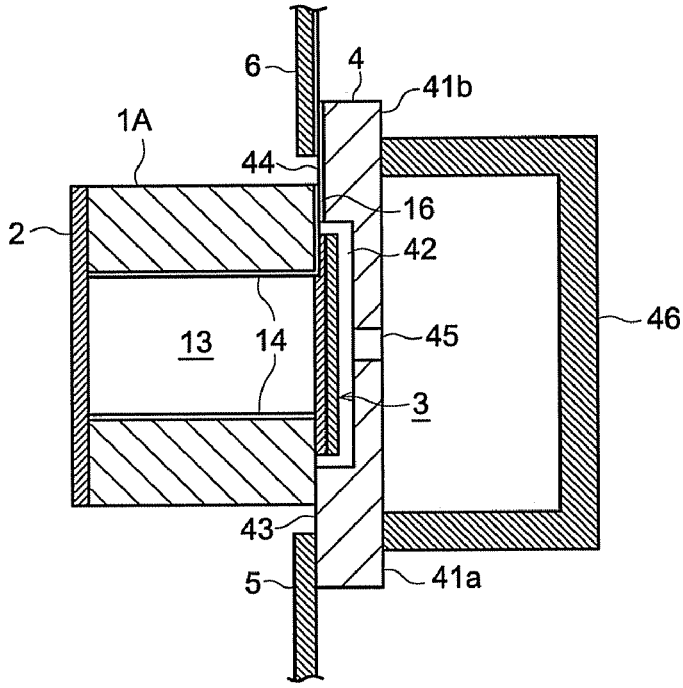
FIG. 8 is a cross sectional view representing an example of the injection head.

The wiring board 4, for example, as shown in FIG. 8 is connected to the rear side of the head chip 1A, whereby the connection electrode 15 and common electrode 16 formed on the rear side of the heed chip 1A are electrically connected with the drive circuit (not illustrated).

FIG. 8 is a cross sectional view wherein the head chip 1A connected with the wiring board 4 is cut at the air channel 13.

The wiring board 4 is formed of a plate-formed substrate which is made up of a ceramic material such as a nonpolarizable PZT, AIN-BN and AIN. Plastic and glass of low thermal expansion can also be used. Further, the same substrate material as that of the piezoelectric element substrate used in the head chip 1 can be used for depolarization. Further, to reduce the distortion of the head chip 1 resulting from the difference in coefficient of thermal expansion, the material is preferably selected so that the difference in the coefficient of thermal expansion from the head chip 1A will be kept within ±1 ppm. The number of the materials constituting the wiring board 4 is not restricted to one. Several sheets of thin plate-formed substrate materials can be laminated to get a desired thickness.

The wiring board 4 extends in the direction perpendicular to the direction of a row of the channels of the head chip 1A (in the vertical direction in FIG. 8). The overhangs 41*a* and 41*b* that hangs substantially over the upper side and lower side of the head chip 1A are provided. Further, one concave portion 42 extending across the width (in the direction of channel row) is formed on one surface of the wiring board 4 connected with the rear side of the head chip 1A. This concave portion 42 is provided with a groove large enough to cover the apertures 122 and 132 on the rear side of all the channels 12 and 13 in the direction of the channel row of the head chip 1A. This constitutes a common ink chamber for supplying ink to each of the ink channels 12 (not illustrated in FIG. 8).

To be more specific, as shown in FIG. 8, the height of the concave portion 42 in the vertical direction of the drawing is greater than that of each of the channels 12 and 13, and is smaller than the thickness perpendicular to the direction of the channel row of the head chip 1A. Thus, when the wiring board 4 is connected with the rear side of the head chip 1A, the apertures 122 and 132 on the rear side of each of the channels 12 and 13 faces inside the concave portion 42.

The flow path regulating member 3 is built in this concave portion 42. To be more specific, the wiring board 4 is connected to a very narrow area on the rear side of the head chip 1A where the flow path regulating member 3 is not provided.

This area is very close to each of the channels 12 and 13 (e.g., the distance is 0 through 200 μm). This requires a very difficult and high-precision positioning work when one plate-formed flow path regulating member is connected in the conventional manner. However, in the present invention, the flow path regulating member 3 is formed by exposure and development of the photosensitive resin film. This arrangement ensures high-precision positioning, as described above, and allows the channels 12 and 13 to be easily formed in a very close position.

One of the overhangs 41*a* of the wiring board 4 is provided with the wired electrodes 43 (not illustrated in FIG. 8) each having the same number and same pitch as those of the connection electrodes 15 (not illustrated in FIG. 8) formed on the rear side of the head chip 1A. The other overhang 41*b* is provided with a wired electrode 44 for connection with the common electrode 16 formed on the rear side of the head chip 1A. The wiring board 4 is connected to the rear side of the head chip 1A by an anisotropic conductive film or the like so that each of the wired electrodes 43 will be electrically connected with each of the connection electrodes 15, and the wired electrode 44 is electrically connected with the common electrode 16.

When a wiring board 4 is connected to the rear side of the head chip 1A, ink can be supplied to the concave portion 42 serving as a common ink chamber from both ends of the concave portion 42 or one of the ends. It is also possible to form an opening 45 leading from the bottom of the concave portion 42 to the surface opposite to the surface for connection with the head chip 1A, and to further connect a box-shaped ink manifold 46 capable of storing the ink in the amount greater than that of the concave portion 42, as shown in FIG. 8.

When a wiring board 4 is connected to the rear side of the head chip 1A, the aforementioned parylene film 17 is formed preferably before the nozzle plate 2 is connected to the head chip 1A after the wiring board 4 has been connected to the head chip 1A. This arrangement ensures electrical connection between each of the connection electrodes 15 and common electrodes 16, and each of the wired electrodes 43 and 44, and allows a protective film to be formed on the surface of the wired electrodes 43 and 44 facing the concave portion 42 of the wiring board 4 which will be brought in direct contact with ink.

Figure 9:
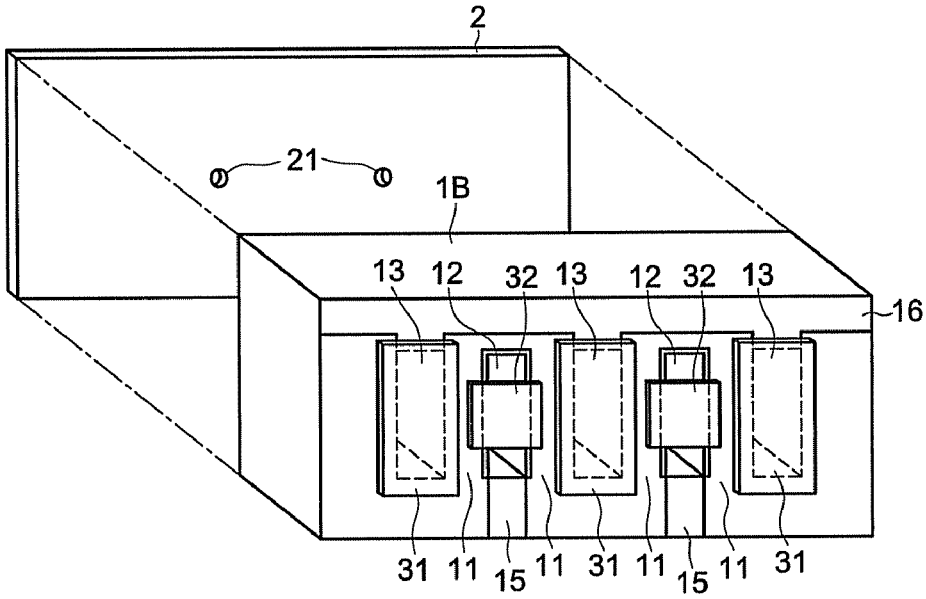
FIG. 9 is a perspective view showing the head chip portion of the injection head as a second embodiment as viewed from the rear side.
Figure 10:
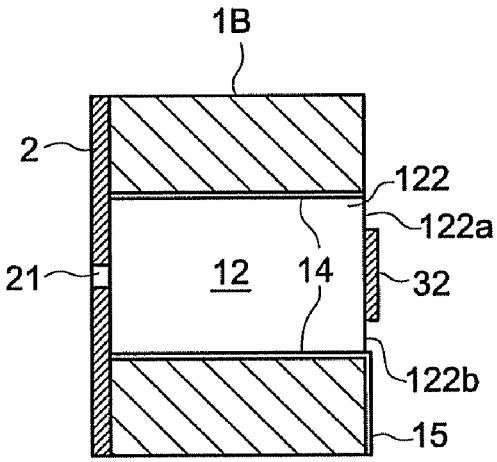
FIG. 10(*a*) is a cross sectional view of the injection head of FIG. 9, with FIG. 10(*b*) being a cross sectional view of an air channel.
Figure 10:
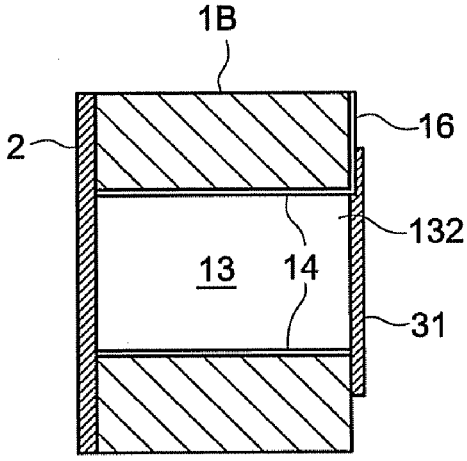

The following describes the second embodiment of the injection head of the present invention:

FIG. 9 is a perspective view of the head chip of the injection head of the second embodiment, as viewed from the rear side. FIG. 10(*a*) is a cross sectional view showing the ink channel 12 of the injection head of FIG. 9, and FIG. 10(*b*) is a cross sectional view of the air channel 13.

The same reference numerals in FIGS. 1 and 2 are assigned to the same components, which will not be described in details to avoid duplication. Further, the method of manufacturing this head chip 1B is the same as that of FIG. 3 and FIG. 4.

In the injection head of the second embodiment, the same flow path regulating member 31 as that of the first embodiment is formed in the air channel 13 of the head chip 1B. At the same time, each ink channel 12 is provided with a flow path regulating member 32 independently so as to reduce the area of the aperture 122 on the rear side thereof.

In the flow path regulating member 32, the direction of width in the direction of the channel row is slightly greater than the width ink channel 12, and the vertical direction perpendicular to the direction of width is smaller than the height of the ink channel 12. Accordingly, the aperture area is reduced by the flow path regulating member 32 to ensure that only the top end and bottom end of each of the apertures 122 on the rear side of the ink channel 12 will open.

Figure 11:
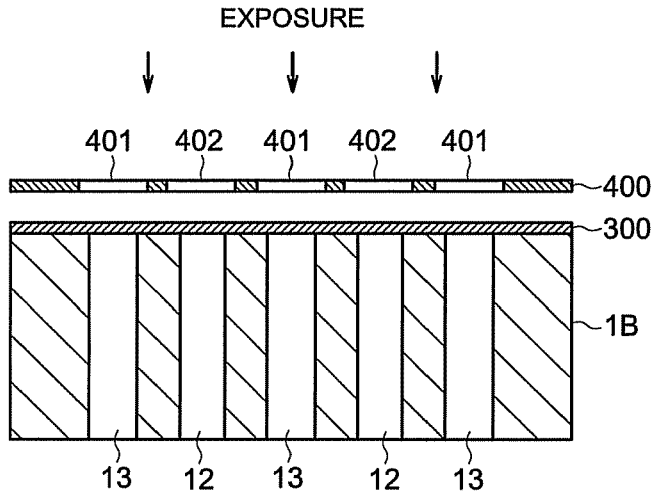
FIG. 11 is a diagram representing the flow path regulating member manufacturing process, wherein (a) is a cross sectional view of the head chip, and (b) is a rear side view of the head chip.
Figure 11:
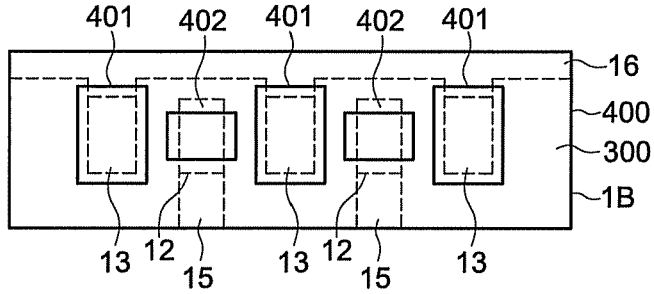
Figure 12:
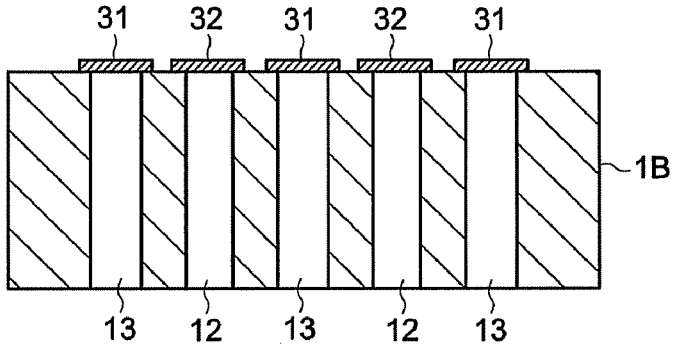
FIG. 12 is a diagram representing the flow path regulating member manufacturing process, wherein (a) is a cross sectional view of the head chip, and (b) is a rear side view of the head chip.
Figure 12:
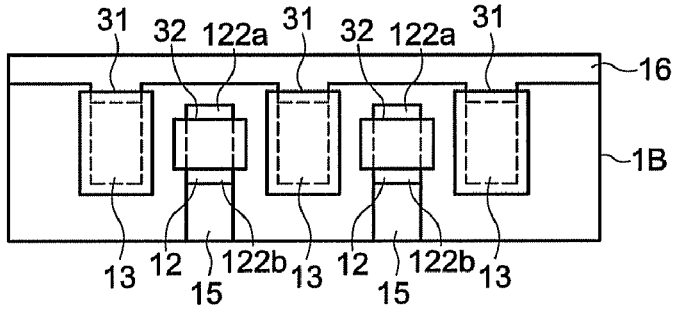

The method of forming this flow path regulating member 32 will be described with reference to FIG. 11 and FIG. 12. In FIG. 11 and FIG. 12, drive electrode 14 is not illustrated.

This flow path regulating member 32 is preferably formed on the rear side of the head chip 1B before the nozzle plate 2 is connected. Accordingly, as shown in FIGS. 11(*a*) and (*b*), the photosensitive resin film 300 is bonded by heat and pressure on all surfaces of the rear side of the head chip 1B, using a laminator apparatus, without using an adhesive, wherein the connection electrode 15 and common electrode 16 have already been formed on the rear side of this head chip 1B. In this case, both the apertures 122 and 132 on the rear side of each of the air channel 13 and the ink channels 12 is completely blocked by the photosensitive resin film 300, similarly to the case of FIG. 5.

The thickness of this photosensitive resin film 300, namely, the thickness between flow path regulating members 31 and 32 can be made the same as that of the aforementioned flow path regulating member 3.

After that, the surface thereof is coated with a photo mask 400. In addition to the rectangular opening 401 having an aperture area slightly greater than that of the aperture 132 on the rear side of each of the air channels 13 of the head chip 1B, this photo mask 400 has an rectangular opening 402 having an aperture area which is slightly smaller than that of the aperture 122 on the rear side of each of the ink channels 12 and which does not lead to the top end and bottom end of the aperture 122. Light is allowed to pass through these openings 401 and 402 alone. Light is applied by using this photo mask 400, whereby light is applied only to the photosensitive resin film 300 around each of the ink channels 12 and each of the air channels 13 exposed to light.

After coating of such a photo mask 400, ultraviolet ray is applied from the side of the photo mask 400 for exposure, similarly to the case of FIG. 5. Then the photo mask 400 is removed, and the material is subjected to the processes of development, rinsing, drying, post-exposure and baking.

Thus, as shown in FIGS. 12(*a*) and (*b*), a flow path regulating member 31 made up of a photosensitive resin film is independently formed on the rear side of the head chip 1B so as to block the aperture 132 on the rear side of each of the air channels 13. At the same time, the flow path regulating member 32 made up of the photosensitive resin film is independently formed so as to reduce the area of the aperture 122 on the rear side of each of the ink channels 12.

After having been bonded by heat and pressure using a photosensitive resin film 300, without using an adhesive, this flow path regulating member 32 is formed by exposure and development are performed through lamination of the photo masks 400 with an opening 402 having a predetermined pattern. This arrangement eliminates the possibility of the channel being clogged by adhesive. Further, the member is formed by patterning through exposure and development. This arrangement ensures high-precision reduction in the area of the aperture 122 on the rear side of each of the ink channels 12.

When the wiring board 4 is to be connected after the flow path regulating members 31 and 32 have been formed as in the case of FIG. 8, a parylene film 17 is preferably formed on all the surfaces of the head chip 1B, namely, on the surface of each of the drive electrode 14 and the surfaces of the flow path regulating members 31 and 32, subsequent to connection, similarly to the case of FIG. 7.

In the head chip 1 of the second embodiment, the area of the aperture 12 on the rear side of each of the ink channels 12 is reduced by the flow path regulating member 32. This arrangement permits an effective reduction in the vibration of the ink meniscus of the nozzle when the head is driven at a high speed, similarly to the conventional case of using the flow path regulating plate with the ink inlet kept open.

Figure 13:
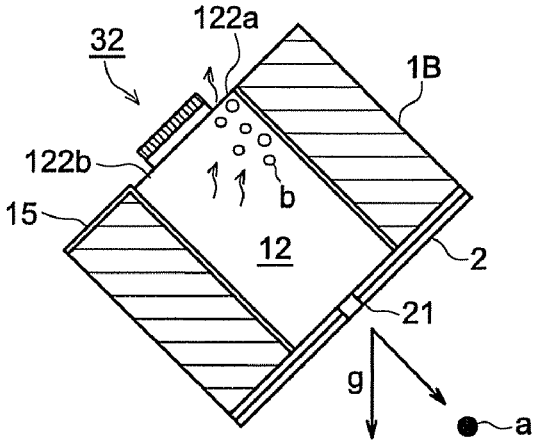
FIG. 13 is a cross sectional view showing the head chip portion when the injection head is arranged in a slanting direction.

Moreover, unlike the case of an ink inlet being formed at the center of the aperture of the ink channel as in the conventional art, this flow path regulating member 32 is designed in such a way that the top end and bottom end of the aperture 122 of the ink channel 12 are opened to form the apertures 122*a* and 122*b*. Thus, when the injection head is placed in an inclined position, as shown in FIG. 13, so that the direction of emission of ink a will be inclined with respect to the direction of gravity g, the aperture (e.g., aperture 122*a*) which is not blocked by the flow path regulating member 32 is located at the top-most position for the ink channel 12. Accordingly, the bubble b produced in the ink channel 12 is collected to this top-most position and is easily removed from the aperture 122*a* to enter the common ink chamber outside the head chip 1B. Even if there is bubble b inside the common ink chamber, it does not affect injection any more. This eliminates the possibility of any problem being caused by bubble b.

The top end and bottom end of this aperture 122 is made to open by the flow path regulating member 32 formed so as to reduce the area of the aperture 122 on the rear side of the of each of the ink channels 12. This arrangement provides a head characterized by excellent bubble removing performance and injection reliability.

In each of the ink channels 12, the area of the aperture 122 on the rear side after having been narrowed by the flow path regulating member 32 is preferably 1 through 10 times the aperture area on the emission side of the nozzle 21 formed on the nozzle plate 2, more preferably 2 through 5 times. The optimum value is preferably obtained from the result of an injection test. According to the test made by the present inventors, the optimum area of the aperture 122 on the rear side after having been reduced by the flow path regulating member 32 is 2000 $\mu m^2$ for the head chip having a nozzle diameter of 28 μm (aperture area: 615 $\mu m^2$).

In this case, the flow path regulating member 32 was formed in such a way that both the top end and bottom end of the aperture 122 of the ink channel 12 are opened to form apertures 122*a* and 122*b*, respectively. This arrangement allows the bubble b to be removed independently of whether the upper side or lower side of the head chip 1B is located on the upper position, and does not impose any restriction when the injection head is installed in a slanting direction. Without the present invention being restricted thereto, the flow path regulating member 32 can be formed in such a way that either the top end or bottom end alone in the aperture 122 on the rear side of the ink channel 12 is open. In this case, the injection head is installed in a slanting direction so that the open side of the apertures 122 on the rear side without being blocked by the flow path regulating member 32 is located on the upper position. This arrangement makes it possible to remove the bubble b.

The first embodiment and the second embodiment use an example of the independent channel type injection head wherein the channels arranged side by side on the head chips 1A and 1B were assigned alternately as ink channels 12 and air channels 13. However, in the head chip, all the channels can be used as ink channels 12.

Figure 14:
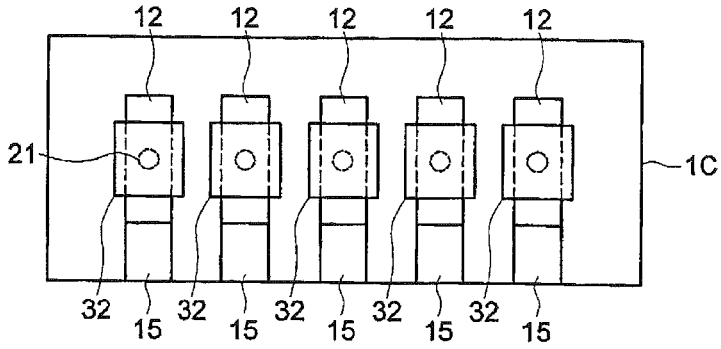
FIG. 14 is a rear side view of the head chip portion of the injection head as a third embodiment.
Figure 15:
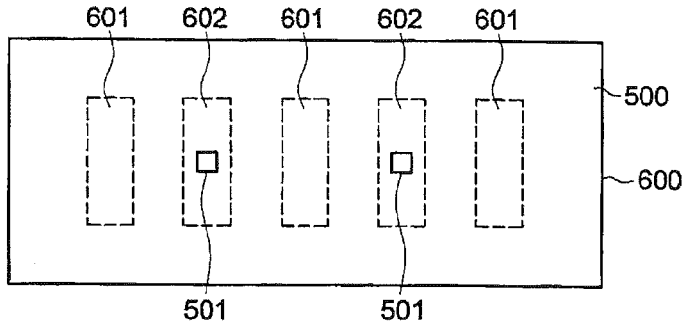
FIG. 15 PRIOR ART
FIG. 15 is a rear side view of the head chip provided with a conventional flow path regulating member.

FIG. 14 indicated the rear side of the head chip 1C in the third embodiment when all the channels are used as ink channels 12. The same reference numerals in FIGS. 1 and 2 indicate the same structure, and will not be described in details. The manufacturing methods of this head chip 1C in FIG. 3 and FIG. 4 are the same. In this case as well, the drive electrode 14 is not illustrated.

As illustrated, a flow path regulating member 32 made up of the photosensitive resin film is formed independently on the aperture 122 on the rear side of each of the ink channels 12 so as to reduce the area of the aperture 122. In this case as well, the area of the aperture 122 on the rear side of each of the ink channels 12 is reduced by the flow path regulating member 32 so that the top end and bottom end are open. Thus, similarly to the case of FIG. 13, install ion of the injection head in a slanting direction ensures easy removal of the bubble from the ink channel 12.

The flow path regulating member 32 can be formed of one flow path regulating member so as to reduce the area of the apertures 122 on the rear sides of all the ink channels 12. In this case as well, as illustrated, if it is formed independently for each ink channel 12, other ink channels 12 are not affected by the problems of any of the flow path regulating members 32.

In this embodiment, it goes without saying that the flow path regulating member 32 can be formed in such a way that either the top end or bottom end alone in the aperture 122 on the rear side of the ink channel 12 is open.

In the aforementioned description, the head chips 1A, 1B and 1C constituting the injection head each have only one channel row. However, a plurality of channel rows can be used. In this case, the flow path regulating members 3, 31 and 32 can be applied in the same manner.

The aforementioned embodiment provides an injection head manufacturing method wherein a flow path regulating member is formed on the rear side of the harmonica type head chip without using an adhesive, and there is no possibility of the channel being clogged.

The aforementioned embodiment also provides an injection head manufacturing method wherein bubbles are easily removed from the channel so that bubbles hardly remain inside.

The aforementioned embodiment also provides an injection head having a flow path regulating member on the rear side of the harmonica type head chip, without any possible of the channel being clogged by adhesive.

The aforementioned embodiment also provides an injection head wherein bubbles are easily removed from the channel so that bubbles hardly remain inside.

What is claimed is:

1. A manufacturing method of an inkjet head having a head chip wherein channels and drive walls configured with piezoelectric elements are arranged alternately, apertures of the channels are arranged respectively at a front surface and a rear surface of the head chip, a drive electrode is formed in each channel, and a flow path regulating member arranged at the rear surface of the head chip to regulate ink flow into the channel, wherein shear deformation is caused at the drive wall by applying a voltage so that ink in the channel is emitted, the manufacturing method comprising:

adhering a photosensitive resin film by heat and pressure onto the rear surface of the head chip without using adhesives;

covering the photosensitive resin film by a photo mask having openings in shape of a predetermined pattern;

exposing and developing the photosensitive resin film covered by the photo mask so as to form the flow path regulating member;

coating both surfaces of the flow path regulating member by coating the head chip with a film made of paraxylylene and derivatives thereof after forming the flow path regulating member; and adhering a nozzle plate onto a front surface of the head chip afterward.

* * * * *